US011140942B2

(12) United States Patent
Labonte

(10) Patent No.: US 11,140,942 B2
(45) Date of Patent: Oct. 12, 2021

(54) SKATE BOOT HAVING A LACE MEMBER WITH AT LEAST ONE OPENING

(71) Applicant: BAUER HOCKEY, LLC, Exeter, NH (US)

(72) Inventor: Ivan Labonte, Montreal (CA)

(73) Assignee: BAUER HOCKEY LLC, Exeter, NH (US)

( * ) Notice: Subject to any disclaimer, the term of this patent is extended or adjusted under 35 U.S.C. 154(b) by 204 days.

(21) Appl. No.: 16/262,244

(22) Filed: Jan. 30, 2019

(65) Prior Publication Data

US 2019/0159545 A1 May 30, 2019

Related U.S. Application Data

(63) Continuation of application No. 15/452,230, filed on Mar. 7, 2017, now Pat. No. 10,231,508, which is a continuation of application No. 13/827,161, filed on Mar. 14, 2013, now Pat. No. 9,622,539.

(51) Int. Cl.

| | |
|---|---|
| ***A43B 5/16*** | (2006.01) |
| ***A43B 3/24*** | (2006.01) |
| ***A43B 23/02*** | (2006.01) |
| ***A43C 1/00*** | (2006.01) |
| ***A43C 11/00*** | (2006.01) |

(52) U.S. Cl.

CPC ..... *A43B 5/1666* (2013.01); *A43B 3/242* (2013.01); *A43B 5/1691* (2013.01); *A43B 23/027* (2013.01); *A43B 23/0275* (2013.01); *A43C 1/003* (2013.01); *A43C 11/00* (2013.01)

(58) Field of Classification Search

CPC ..... A43B 5/1666; A43B 5/1691; A43B 3/342; A43B 23/027; A43B 23/0275; A43C 1/00; A43C 1/003; A43C 1/06

See application file for complete search history.

(56) References Cited

U.S. PATENT DOCUMENTS

| | | |
|---|---|---|
| 1,408,563 A | 3/1922 | Leffingwell |
| 2,253,860 A | 8/1941 | Martin |

(Continued)

FOREIGN PATENT DOCUMENTS

| | | |
|---|---|---|
| CA | 2256932 | 6/2000 |
| DE | 0109380 | 5/1984 |
| EP | 2777416 | 3/2015 |

OTHER PUBLICATIONS

European Search Report dated Aug. 5, 2013 in connection with European application 13159496.2, 5 pages.

(Continued)

*Primary Examiner* — Ted Kavanaugh

(57) ABSTRACT

A skate boot comprising an outer shell including medial and lateral side portions for facing the medial and lateral sides of the foot. Each of the medial and lateral side portions has an upper edge. The skate boot also comprises a lace member mounted to either of the upper edges of the medial and lateral side portions. The lace member has at least one opening for receiving an insert. The lace member has a first flexion mode when no insert is received in the at least one opening and a second flexion mode when the insert is received in the at least one opening. The second flexion mode is different from the first flexion mode.

36 Claims, 11 Drawing Sheets

(56) References Cited

U.S. PATENT DOCUMENTS

| | | | | | |
|---|---|---|---|---|---|
| 2,498,437 | A | * | 2/1950 | Hollier | A43B 3/16 36/4 |
| 2,904,902 | A | * | 9/1959 | Murray | A43B 5/1616 280/11.3 |
| 3,483,638 | A | * | 12/1969 | Baso | A43B 5/0488 36/117.1 |
| 4,509,276 | A | | 4/1985 | Bourque | |
| 4,538,367 | A | * | 9/1985 | Adams | A43C 1/00 36/50.1 |
| 4,553,342 | A | | 11/1985 | Derderian | |
| 4,571,782 | A | * | 2/1986 | Ahn | A43C 1/00 24/713.4 |
| 4,633,548 | A | | 1/1987 | Siskind | |
| 4,655,465 | A | | 4/1987 | Schaeffer | |
| 4,916,833 | A | * | 4/1990 | Nwoko | A43C 1/00 24/712.2 |
| 4,974,299 | A | | 12/1990 | Moon | |
| D347,519 | S | * | 6/1994 | Worthington | D2/970 |
| D359,387 | S | * | 6/1995 | Van Noy | D2/969 |
| 5,462,295 | A | * | 10/1995 | Seltzer | A43B 5/1658 280/11.19 |
| 5,640,785 | A | | 6/1997 | Egelja | |
| D384,804 | S | * | 10/1997 | Cooper | D2/972 |
| D404,893 | S | * | 2/1999 | Racine | D2/904 |
| 9,622,539 | B2 | | 4/2017 | Labonte | |
| 10,231,508 | B2 | | 3/2019 | Labonte | |
| 2003/0204971 | A1 | | 11/2003 | Fauver | |

OTHER PUBLICATIONS

Non-final Office Action dated Sep. 29, 2015 in connection with U.S. Appl. No. 13/827,161, 8 pages.

Final Office Action dated Mar. 17, 2016 in connection with U.S. Appl. No. 13/827,161, 11 pages.

Non Final Office Action dated Aug. 15, 2016, in connection with U.S. Appl. No. 13/827,161, 14 pages.

Notice of Allowance dated Dec. 7, 2016 in connection with U.S. Appl. No. 13/827,161, 9 pages.

Supplemental Notice of Allowance dated Dec. 21, 2016 in connection with U.S. Appl. No. 13/827,161, 4 pages.

Examiner's Report dated Nov. 9, 2018 in connection with Canadian patent application No. 2,809,449, 3 pages.

Final Office Action dated Feb. 22, 2018 in connection with U.S. Appl. No. 15/452,230, 9 pages.

Notice of Allowance dated Oct. 31, 2018 in connection with U.S. Appl. No. 15/452,230, 10 pages.

U.S. Pat. No. 854,274 issued on May 21, 1907 (Patent No. not standard, does not fit in the above patent section.

* cited by examiner

SKATE BOOT HAVING A LACE MEMBER WITH AT LEAST ONE OPENING

CROSS-REFERENCE TO RELATED APPLICATIONS

This application is a continuation of U.S. patent application Ser. No. 15/452,230 filed on Mar. 7, 2017, which is a continuation of U.S. patent application Ser. No. 13/827,161 filed on Mar. 14, 2013, now U.S. Pat. No. 9,622,539. The contents of the aforementioned applications are incorporated by reference herein.

FIELD OF THE INVENTION

The present invention relates to a skate boot having medial and lateral lace members, wherein each lace member has at least one opening for receiving an insert and wherein the flexibility of the lace member may be adjusted by a skater between different flexion modes.

BACKGROUND OF THE INVENTION

Skate boots are well known in the art for use in hockey skates, figure skates or roller skates, for example. Conventionally, laces are used to secure the skate boot to the skater's foot although other securement mechanisms such as Velcro™ or snaps can also be used. Regardless of the securement mechanism employed, it is generally desirable that the skate boot exhibit a certain level of flexibility around the skater's ankle in order to accommodate flexing or extension of the skater's ankle.

While some skate boots are made with flexibility issues in mind, they are usually manufactured in bulk with a predefined design. This can present an inconvenience to a potential purchaser if a particular skate or roller blade design is desired (due to its affordability or performance features) because the skate boot may not provide a comfortable fit. Thus, many different skaters with different needs are presented with, at best, a rather limited set of choices with regard to the flexibility characteristics of a given design.

As it is of interest to accommodate the needs of different skaters, much time and effort is invested in developing improvements in skate boots to respond to such needs.

Accordingly, there is therefore an ongoing need in the industry for an improved skate boot structure which overcomes the aforementioned problems and which can accommodate a plurality of different skating styles, modes, types or fashions, as well as the need to provide a skate boot wherein the skater may adjust the flexibility of the skate boot between different flexion modes in the ankle region of the boot.

SUMMARY OF THE INVENTION

In accordance with an aspect of the present invention, there is provided a skate boot for enclosing a human foot when in use. The foot has medial and lateral sides. The skate boot comprises an outer shell including medial and lateral side portions for facing the medial and lateral sides of the foot. Each of the medial and lateral side portions has an upper edge. The skate boot also comprises a lace member mounted to either of the upper edges of the medial and lateral side portions. The lace member has at least one opening for receiving an insert. The lace member has a first flexion mode when no insert is received in the at least one opening and a second flexion mode when the insert is received in the at least one opening. The second flexion mode is different from the first flexion mode.

In accordance with another aspect of the present invention, there is provided a skate boot for enclosing a human foot when in use. The foot has medial and lateral sides. The skate boot comprises an outer shell including medial and lateral side portions for facing the medial and lateral sides of the foot. Each of the medial and lateral side portions has an upper edge. The skate boot also comprises a lace member mounted to either of the upper edges of the medial and lateral side portions. The lace member has at least one opening for receiving an insert. In use, a first insert selected among a plurality of inserts is mounted in the at least one opening such that the lace member has a first flexion mode.

These and other aspects and features of the present invention will now become apparent to those of ordinary skill in the art upon review of the following description of specific embodiments of the invention in conjunction with the accompanying drawings.

BRIEF DESCRIPTION OF THE DRAWINGS

A detailed description of examples of embodiments of the present invention is provided hereinbelow with reference to the following drawings, in which.

Figure 1:
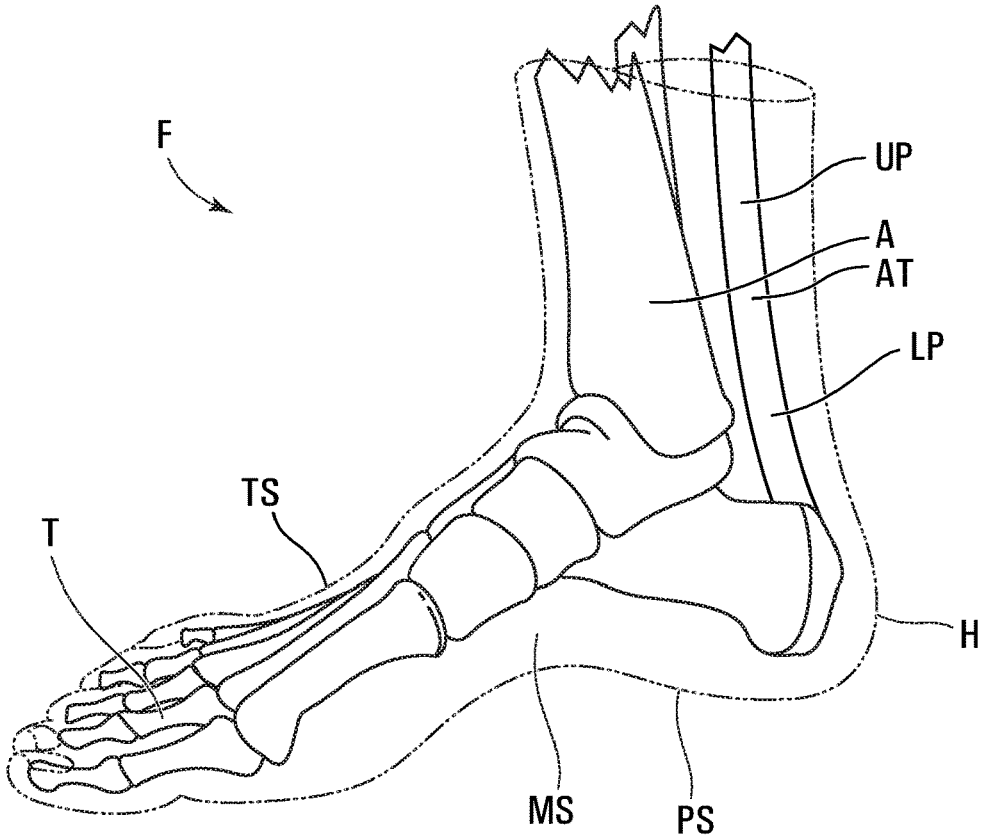
FIG. 1 is a side view of a right human foot with the integument of the foot shown in dotted lines and the bones shown in solid lines.

In the drawings, embodiments of the invention are illustrated by way of example. It is to be expressly understood that the description and drawings are only for the purposes of illustration and as an aid to understanding, and are not intended to be a definition of the limits of the invention.

DETAILED DESCRIPTION OF THE EMBODIMENTS

To facilitate the description, any reference numerals designating an element in one figure will designate the same element if used in any other figures. In describing the embodiments, specific terminology is resorted to for the sake of clarity but the invention is not intended to be limited to the specific terms so selected, and it is understood that each specific term comprises all equivalents.

Unless otherwise indicated, the drawings are intended to be read together with the specification, and are to be considered a portion of the entire written description of this invention. As used in the following description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure. Similarly, the terms "inwardly," "outwardly" and "radially" generally refer to the orientation of a surface relative to its axis of elongation, or axis of rotation, as appropriate.

Figure 2:
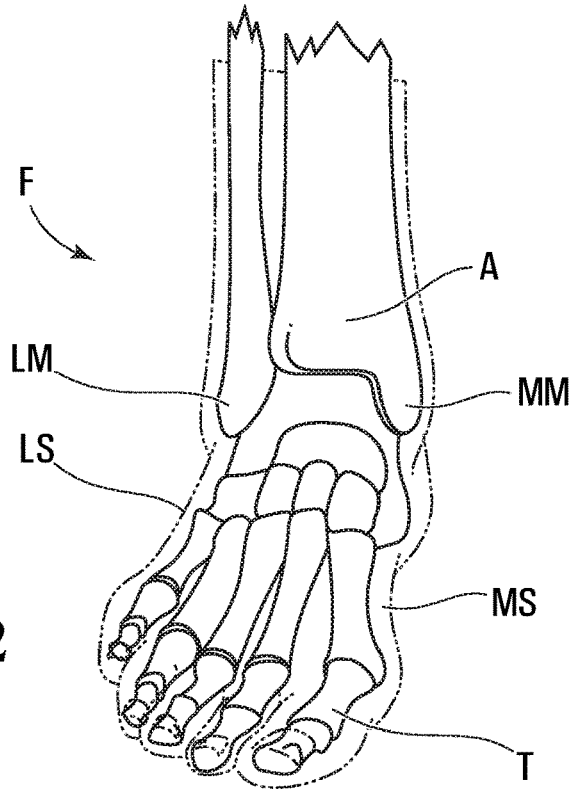
FIG. 2 is a front view of the human foot of FIG. 1.

Shown in FIGS. 1 and 2 is a typical right human foot F that includes toes T, a plantar surface PS, a top surface TS, a medial side MS and a lateral side LS. In addition, the human foot includes a heel H, an Achilles tendon AT and an ankle A having a lateral malleolus LM and a medial malleolus MM, the lateral malleolus LM being at a lower position than the medial malleolus MM. The Achilles tendon AT has an upper part UP and a lower part LP projecting outwardly with relation to the upper part UP, the lower part merging with the heel H.

Figure 3:
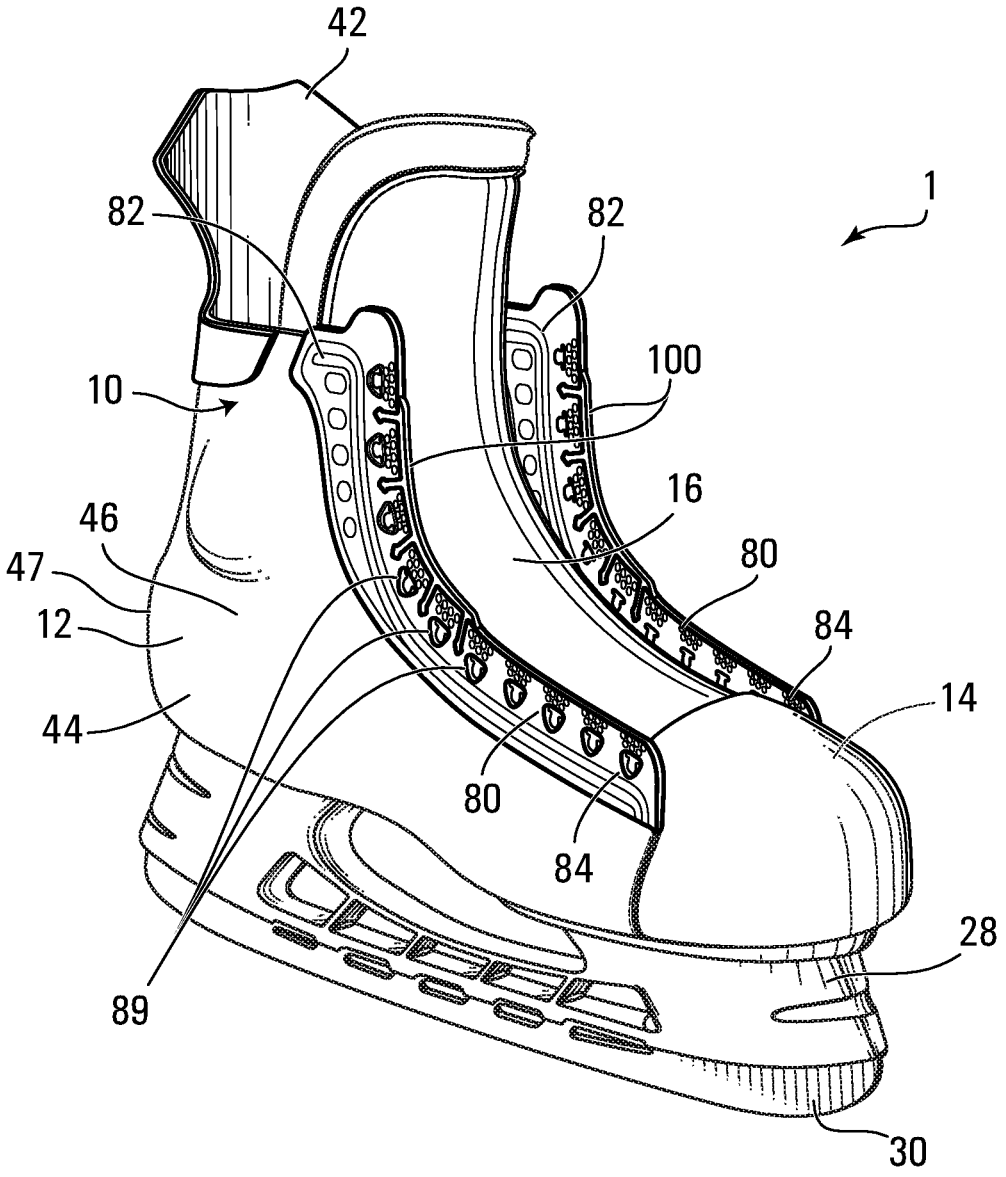
FIG. 3 is a perspective view of an ice skate in accordance with the present invention.
Figure 4:
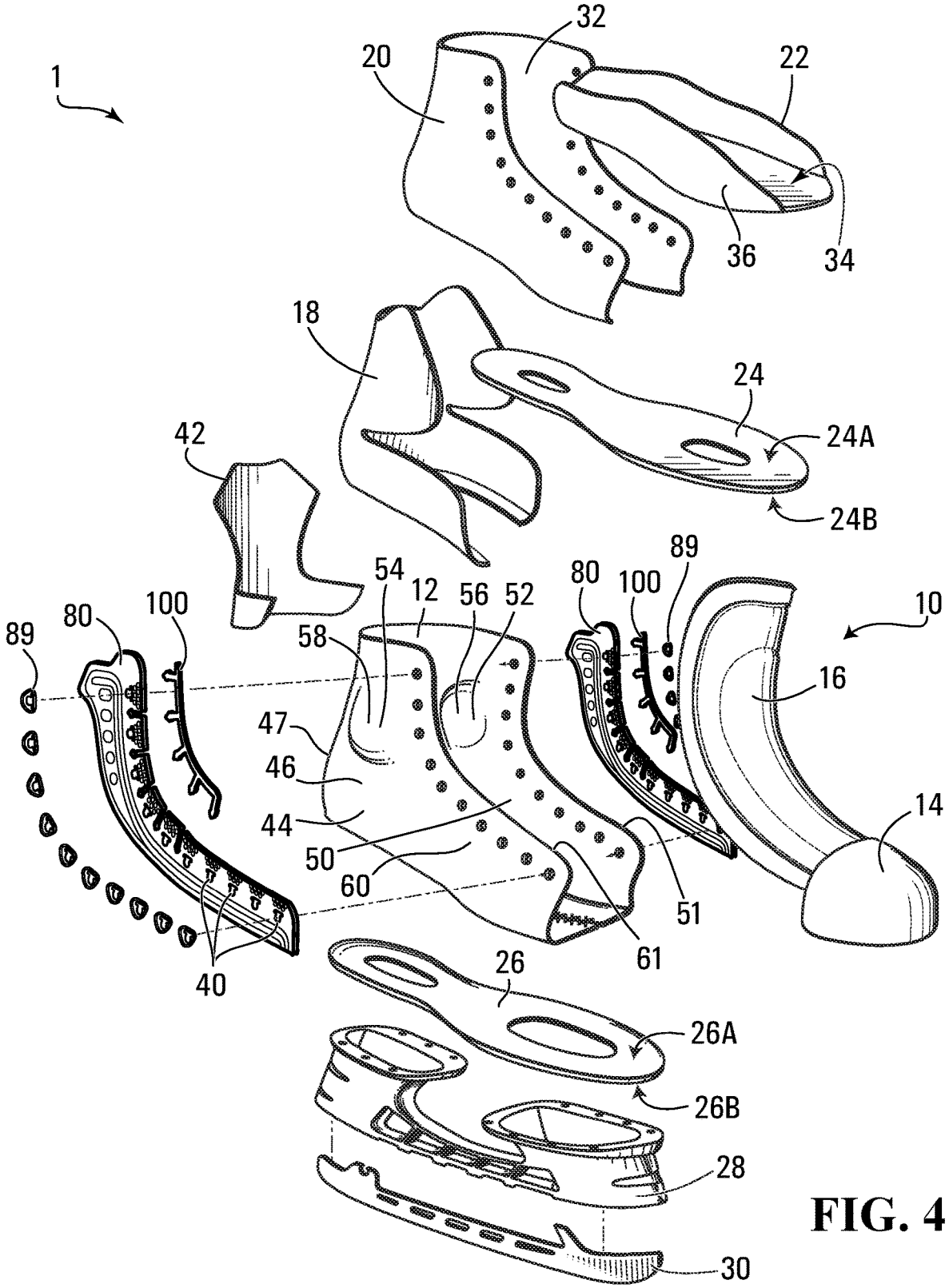
FIG. 4 is an exploded view of the ice skate of FIG. 3.

Shown in FIGS. 3 and 4 is an ice skate 1 that comprises a skate boot 10 suitable for enclosing the foot F. Although the skate boot 10 shown in the figures is being used for an ice skate 1, it is understood that the skate boot 10 can be used for a roller skate.

The ice skate 1 has an outer shell 12 for receiving the foot F, a toe cap 14 made of rigid molded plastic for facing the toes T, a tongue 16 extending upwardly and rearwardly from the toe cap 14 for covering the top surface TS of the foot F, a rigid insert 18 for providing more rigidity around the ankle A and heel H, an inner lining 20, a footbed 22, an insole 24, an outsole 26, an ice skate blade holder 28 and a blade 30. The rigid insert 18 may be glued to an inner surface of the outer shell 12. It is understood that the rigid insert 18 is an optional component and may be eliminated if the outer shell 12 is sufficiently rigid for supporting the ankle A and heel H. Similarly, the insole 24 and outsole 26 are optional components and may be eliminated if the outer shell 12 is sufficiently rigid for receiving the blade holder 28.

The inner lining 20 is affixed to an inner surface of the outer shell 12 and it comprises an inner surface 32 intended for contact with the heel H, ankle A and medial and lateral sides MS, LS of the foot F in use. If the skate boot 10 comprises the rigid insert 18, such rigid insert 18 is sandwiched between the outer shell 12 and inner lining 20 and such inner lining 20 may be glued to the inner surfaces of the outer shell 12 and rigid insert 18 and stitched along its periphery to the outer shell 12. The inner lining 20 is made of a soft material and can be a fabric made of 100% NYLON® fibers. The footbed 22 is mounted inside the outer shell 12 and it comprises an upper surface 34 for receiving the plantar surface PS of the foot F and a wall 36 projecting upwardly from the upper surface 34. The wall 36 partially cups the heel H and extends up to a medial line of the foot F.

The skate boot 10 also comprises lace members 80 with openings 90 for receiving inserts 100 as will be described in further detail below. The lace members 80 may be made of fabric, textile, leather or plastic and comprise apertures 40 for receiving laces. Eyelets 89 may be punched into the apertures 40 of lace members 80, outer shell 12 and inner lining 20 vis-à-vis apertures 40.

The outer shell 12 is thermoformed such that it comprises a heel portion 44 for receiving the heel H, an ankle portion 46 for receiving the ankle A and medial and lateral side portions 50, 60 for facing the medial and lateral sides MS, LS of the foot F respectively.

These components form a foot receiving cavity that conforms to the general shape of the foot F. In addition, each of the medial and lateral side portions 50, 60 include a respective upper edge 51, 61 which connects to a respective lace member 80. The heel portion 44 may be thermoformed such that it is substantially cup shaped for following the contour of the heel H.

The ankle portion 46 comprises medial and lateral ankle sides 52, 54. The medial ankle side 52 has a medial cup-shaped depression 56 for receiving the medial malleolus MM and the lateral ankle side 54 has a lateral cup-shaped depression 58 for receiving the lateral malleolus LM. The lateral depression 58 is located slightly lower than the medial depression 56, for conforming to the morphology of the foot F. The ankle portion 46 further comprises a rear portion 47 facing the lower part LP of the Achilles tendon AT. The rear portion 47 may be thermoformed such that it follows the lower part LP of the Achilles tendon AT. The medial and lateral side portions 50, 60 of the outer shell 12 extend forwardly from the heel and ankle portions 44, 46.

As shown in FIG. 4, the skate boot 10 may comprise the insole 24 that has an upper surface 24A for facing the plantar surface PS of the foot and a lower surface 24B on which the a sole portion 25 of the outer shell 12 may be affixed. The outsole 26 of the skate boot 10 also has an upper surface 26A on which the sole portion 25 of the outer shell 12 may be affixed and a lower surface 26B on which the blade holder 28 is mounted. It is however understood that the insole 24 and outsole 26 are optional components and may be eliminated if the sole portion 25 of the outer shell 12 is sufficiently rigid for receiving the blade holder 28. Alternatively, only the outsole 26 may be eliminated and the insole 24 may still be used in the construction of the skate boot 10.

As shown in FIGS. 3 and 4, the skate boot 10 may also comprise a tendon guard 42 for protecting the Achilles tendon AT.

Figure 5:
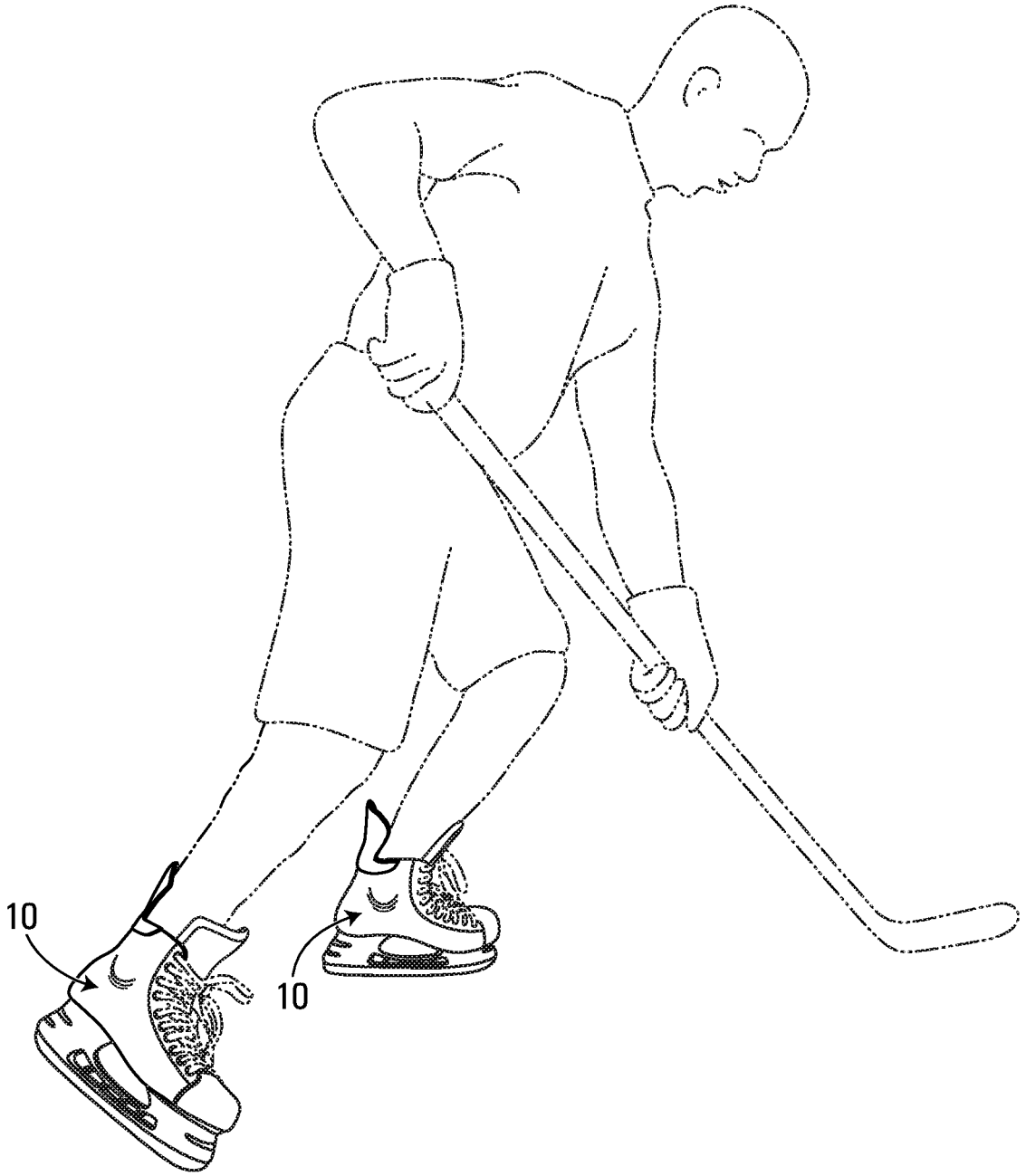
FIG. 5 shows a skater in a skating position.

With reference to FIG. 5, a skater is shown with a pair of ice skates 1. It can be seen that the skater's feet are in different positions. As such, each of the skater's feet F induces different forces onto their respective skate boots 10. This is especially true for the portions of the skate boot 10 which overly the ankle A and the top surface TS of the skater's foot F (i.e.: in the upper portions of the lace members 80).

More specifically, the left foot F is in a substantially flexed position while the right foot F is in a substantially extended position. On a traditional pair of skates, the flexibility of the skate boot 10 would not be adjustable and could possibly cause discomfort to the skater. For example, if the skate boot 10 is too flexible, this may provide for an insecure (loose) fit on the skater's foot F. On the other hand, if the skate boot 10 is too rigid, the skater may experience discomfort during various skating maneuvers as his or her feet F and ankles A may be over-restrained.

It is therefore a feature of the lace member 80 to allow the skater to adjust the flexibility of the skate boot 10.

Referring to FIGS. 6 to 12, the lace member 80 is shaped to be mounted to the upper edge 61 of the lateral side portion 60 of the outer shell 12 and to the upper edge 51 of the medial side portion 50 of the outer shell.

Figure 7:
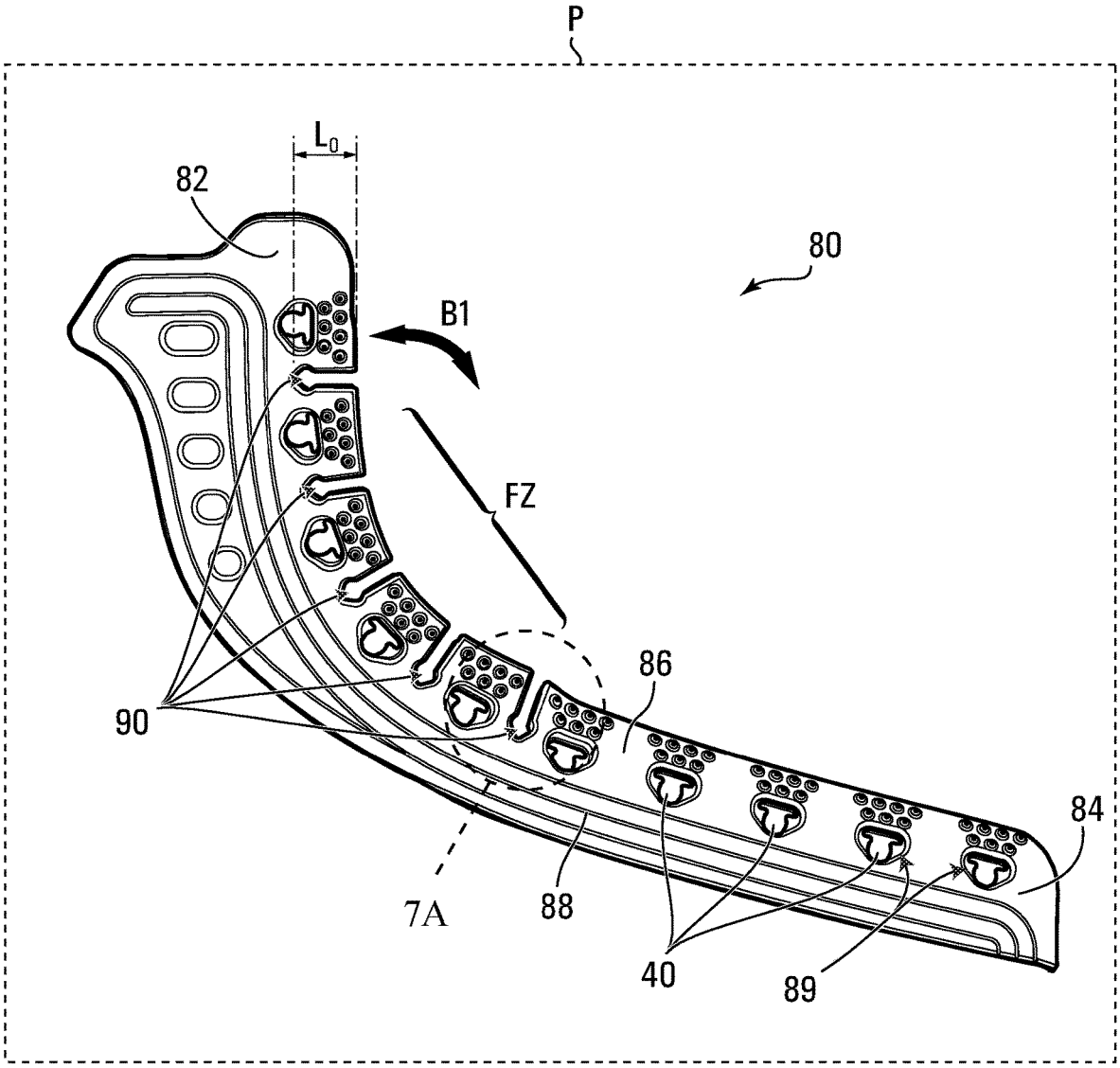
FIG. 7 shows a side view of a lace member in accordance with the present invention.
Figure 7A:
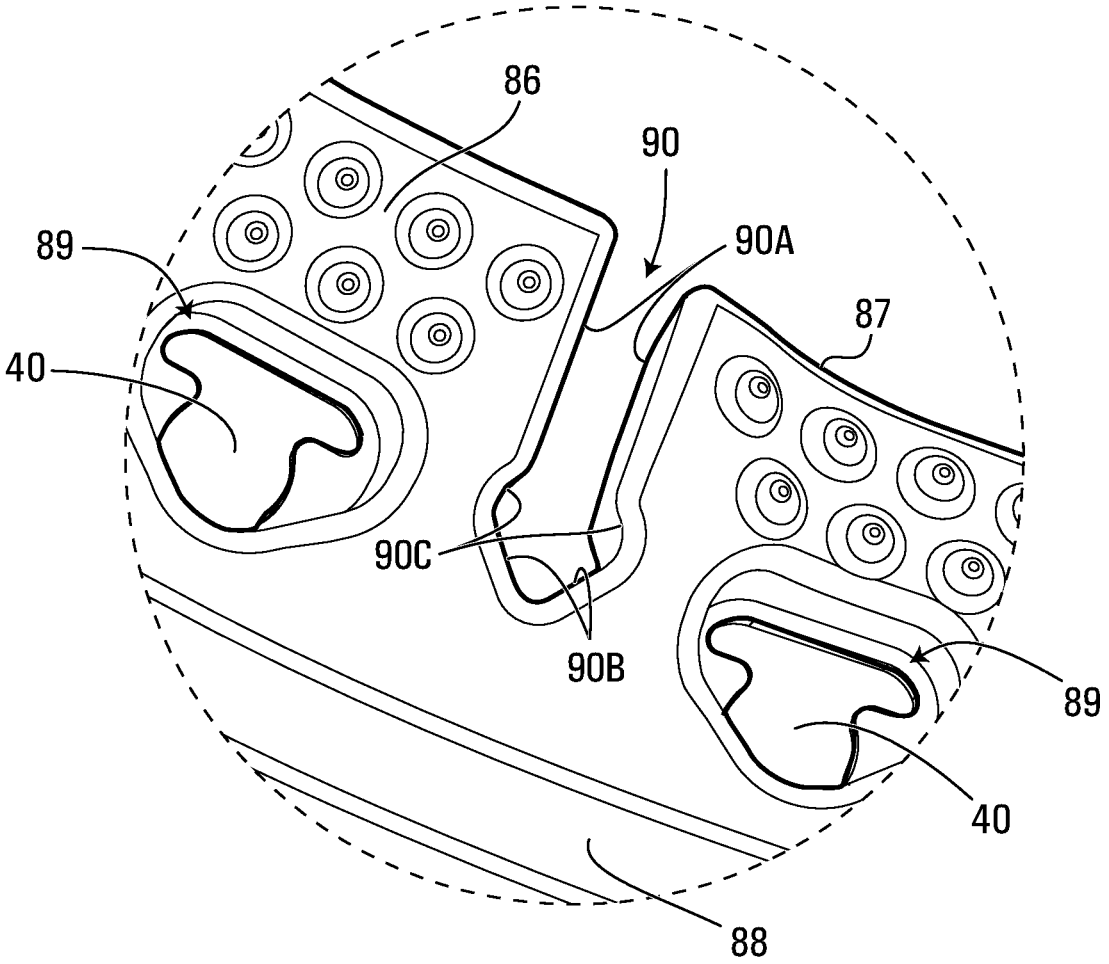
FIG. 7A shows an enlarged partial view of the lace member of FIG. 7.
Figure 8:
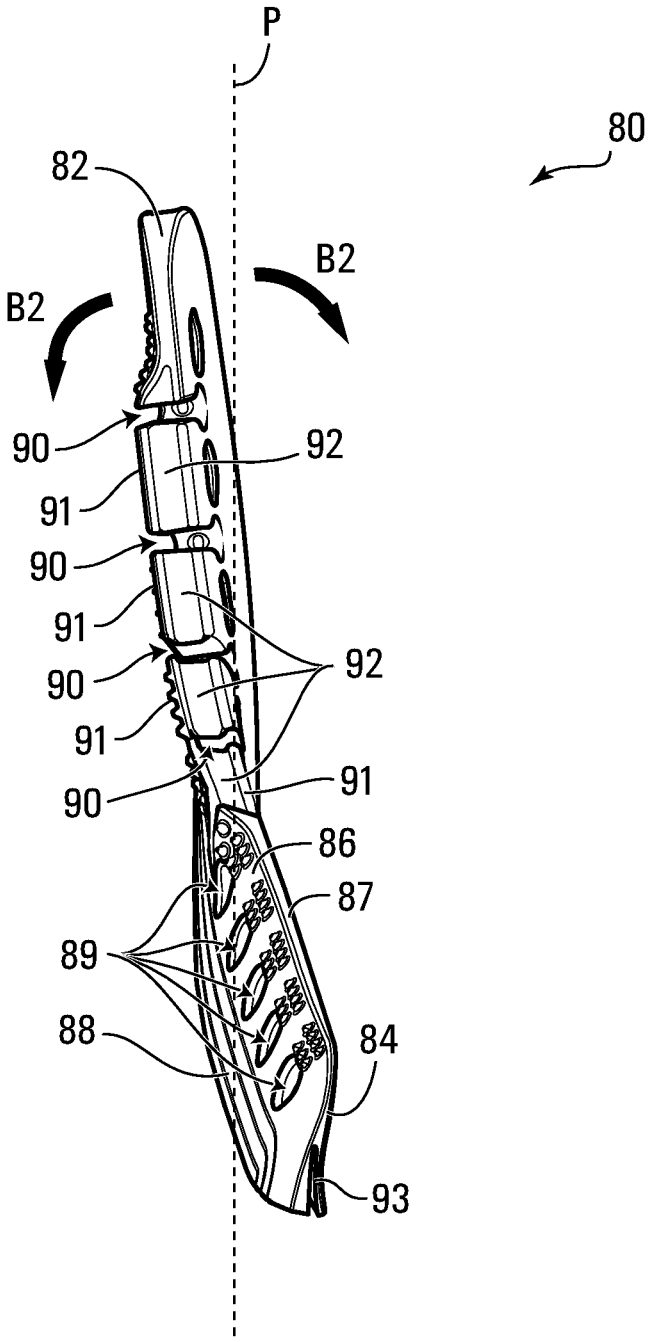
FIG. 8 shows a front view of the lace member of FIG. 7.

With specific reference to FIGS. 7, 7A and 8, the lace member 80 includes a proximal portion 82, a distal portion 84, a top portion 86 with a top edge 87, a bottom portion 88 and a plurality of eyelets 89 and openings 90. The bottom portion 88 serves as an attachment portion for mounting the lace member 80 to the outer shell 12 of the skate boot 10.

As best seen in FIG. 3, when the lace member 80 is mounted to either of the upper edges 51, 61 of the medial or lateral side portions 50, 60, the proximal portion 82 of the lace member 80 is positioned adjacent the top portion of the ankle portion 46 of the outer shell 12 while the distal portion 84 of the lace member 80 is positioned adjacent the toe cap 14 of the skate boot 10.

As best shown in FIG. 8, the top edge 87 may have edge portions 91, each defining a groove 92 and being located between two openings 90.

The openings 90 extend from the top edge 87 of the top portion 86 of the lace member 80 in a direction towards the bottom portion 88 of the lace member 80. Each of the openings 90 may have a substantially elongated shape defined by opposed walls 90A, opposed distal inclined walls 90B and opposed rounded walls 90C located between the opposed walls 90A and opposed distal inclined walls 90B (see FIG. 7A). The opposed walls 90A extend from the top edge 87 of the top portion 86 and the distal inclined walls 90B may be located between two apertures 40 (or eyelets 89). A plurality of protuberances, bumps, projections or friction means may be provided on the outer surface of the lace member 80 above the apertures 40/eyelets 89 in order to increase friction action between the lace and the outer surface of the lace member 80.

Although the openings 90 have been described in accordance with a specific embodiment, it is understood that the dimensions, orientation, position and number of the openings of the lace member 80 can vary from one embodiment to another.

In one embodiment, the lace member 80 may include five openings 90, each of which may have a length $L_O$ of approximately 1.25 cm. However, in other embodiments, the length $L_O$ of the openings can be between 0.5 cm and 3 cm and the lace member 80 may include three openings instead of five.

While each of the openings 90 are of similar shape, it should be noted that openings of a given lace member 80 may also be shaped differently from one another.

Furthermore, while the elongated openings 90 extend in a direction generally perpendicular to the top edge 87, openings of a give lace member 80 can be oriented in any other transversal direction relative to the top edge 87.

The openings 90 are preferably positioned in a region of the lace member 80 which is most likely to bend when the skater's foot is flexed or extended. This region of the lace member 80 is generally referred to as a flexion zone FZ (see FIGS. 7, 11 and 12).

As best shown in FIG. 8, the bottom portion 88 of the lace member 80 defines a slit 93 which extends throughout the length of the lace member 80 for mounting the lace member 80 to either of the upper edges 51, 61 of the medial or lateral side portions 50, 60 of the outer shell 12. In the embodiment shown, the slit 93 is relatively thin. However, in other embodiments, the bottom portion 88 of the lace member 80 can define a more pronounced opening to receive the outer shell upper edges of thicker dimensions. In such cases, the slit can be an inverted "U-shaped" groove (a "saddle" shape). The lace member 80 can be mounted to the upper edges 51, 61 of the medial or lateral side portions 50, 60 of the outer shell 12 via any method known in the art such as stitching, over molding, thermal bonding, high frequency welding, vibration welding, piping, zipper, adhesive and staples, or any combination thereof. In yet other embodiments, the lace member can form an integral part of the outer shell 12.

With reference to FIG. 7, the lace member 80 has a curved shape which generally lies within a plane P. The shape of the lace member 80 is predefined to accommodate the curvatures of the upper edges of the 51, 61 of the medial or lateral side portions 50, 60 of the outer shell 12. Furthermore, the lace member 80 may be made of a material which exhibits a degree of flexibility to respond to flexing of the skater's feet F. For example, the lace member 80 may be made of silicone or may be made by injection molding using polyester (e.g. polyester HYTREL®), polyurethane, polyamide, or other suitable thermoplastics.

The lace member 80 may be more flexible than the outer shell 12. For instance, the lace member 80 may be capable of in-plane bending (as depicted by bending arrows B1 in FIG. 7) and the lace member 80 may also be capable of out-of-plane bending (as depicted by bending arrows B2 in FIG. 8). The in-plane bending will result in the proximal portion 82 of the lace member 80 bending towards or away from the distal portion 84 of the lace member 80 such as to accommodate flexion and extension of a skater's foot F. The out-of-plane bending may allow the lace member 80 to wrap around the skater's ankle A and foot F (as required during tightening of the skate boot 10).

Figure 6:
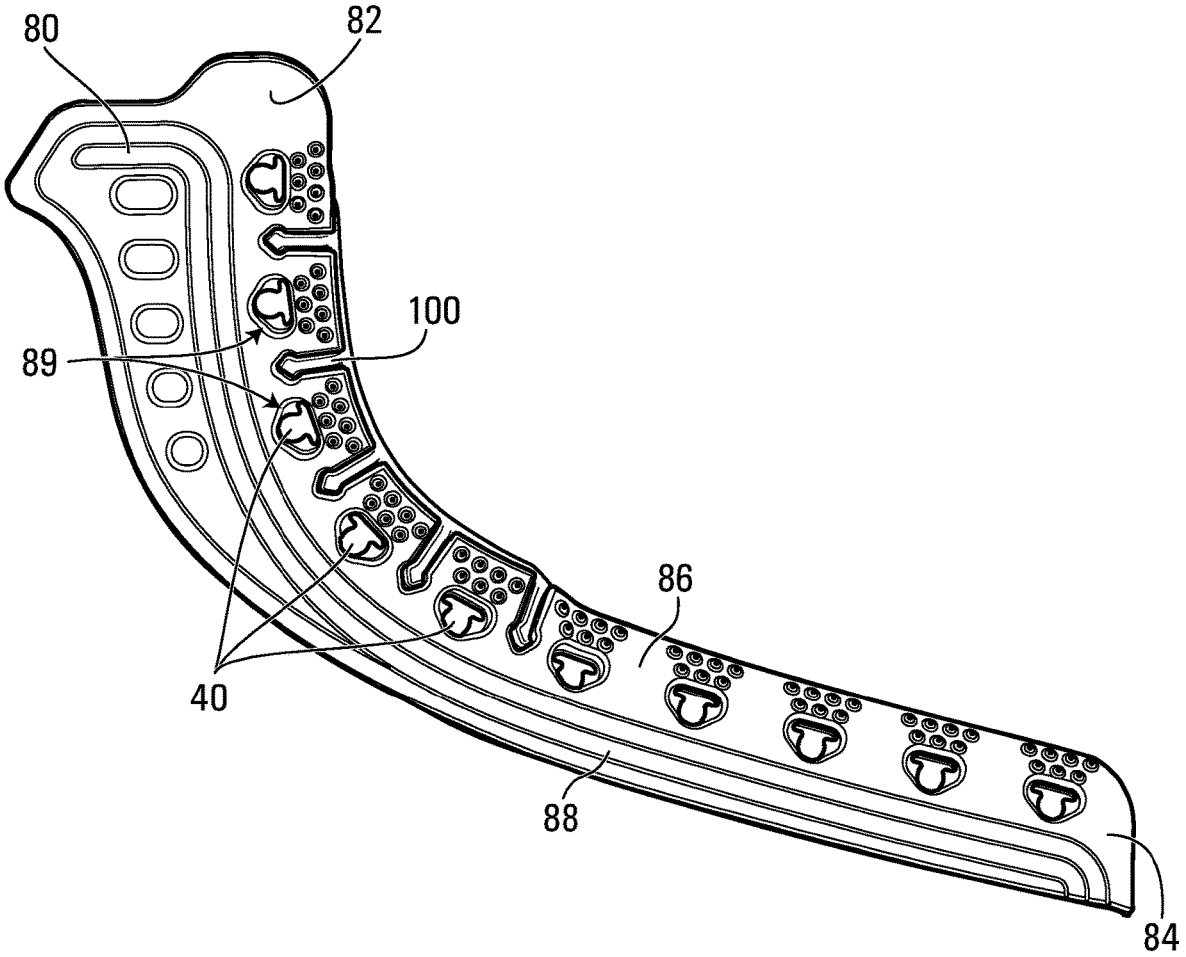
FIG. 6 shows a side view of a lace member and an insert in accordance with the present invention, the insert being positioned in the lace member.
Figure 9:
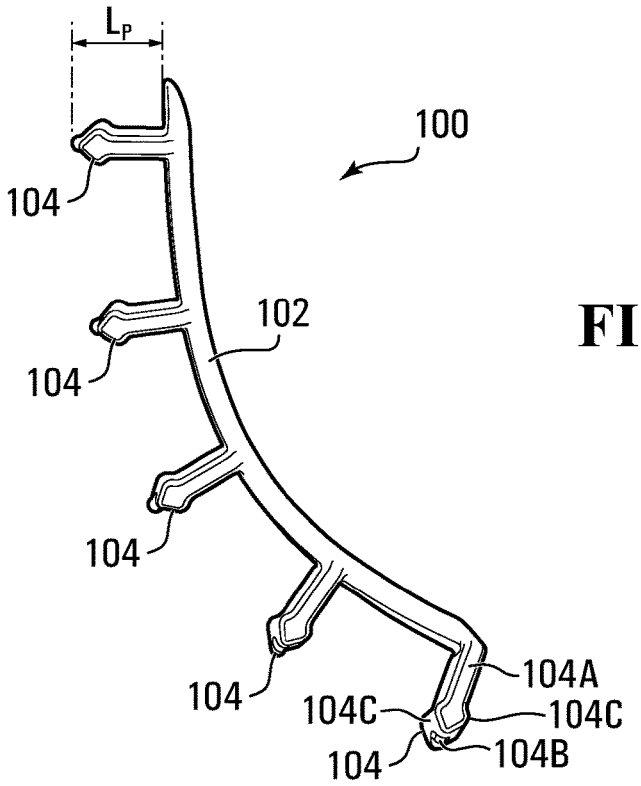
FIGS. 9 and 10 show different embodiments of an insert in accordance with the present invention.
Figure 11:
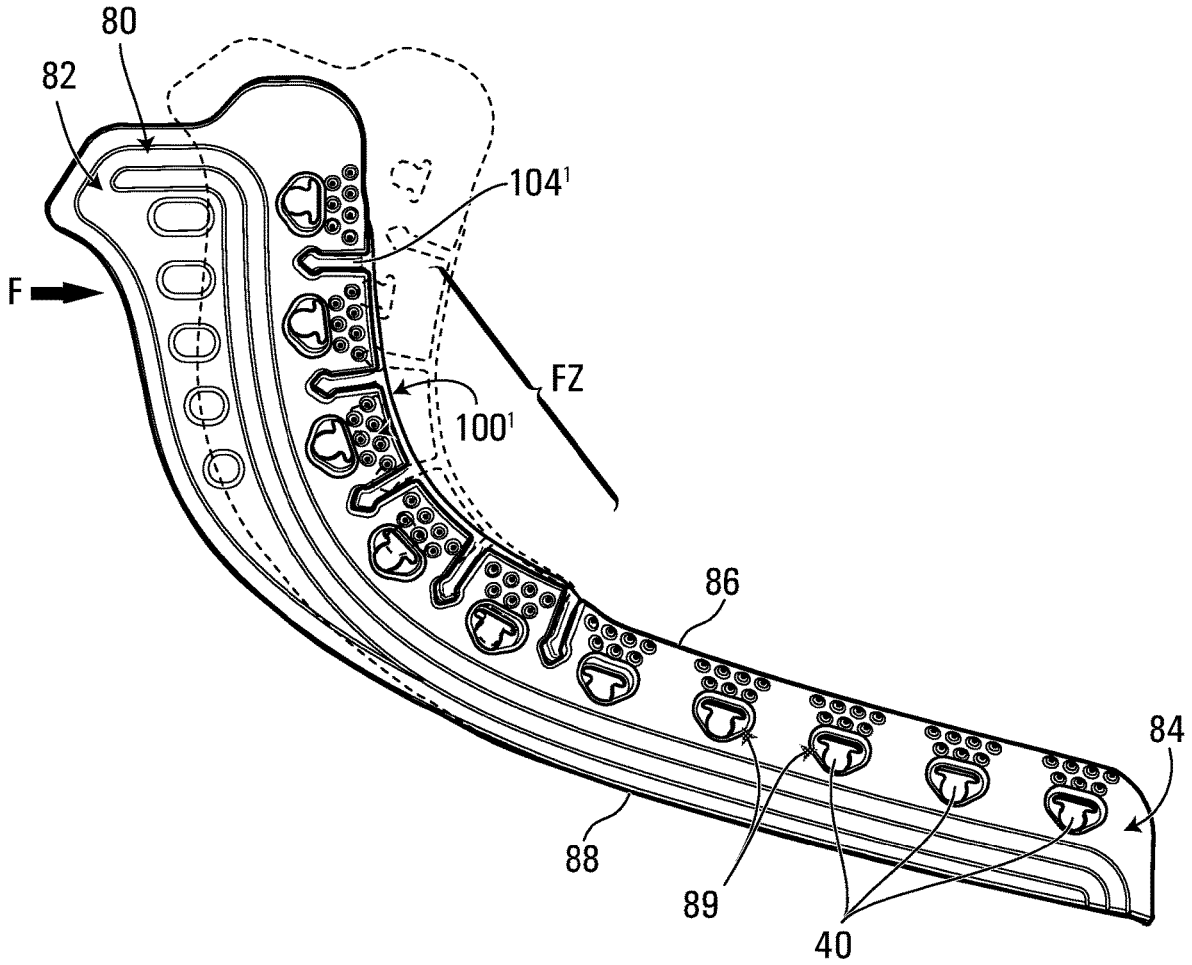
FIGS. 11 and 12 show a side view of the lace member and insert of FIG. 6 exhibiting different flexion modes.
Figure 12:
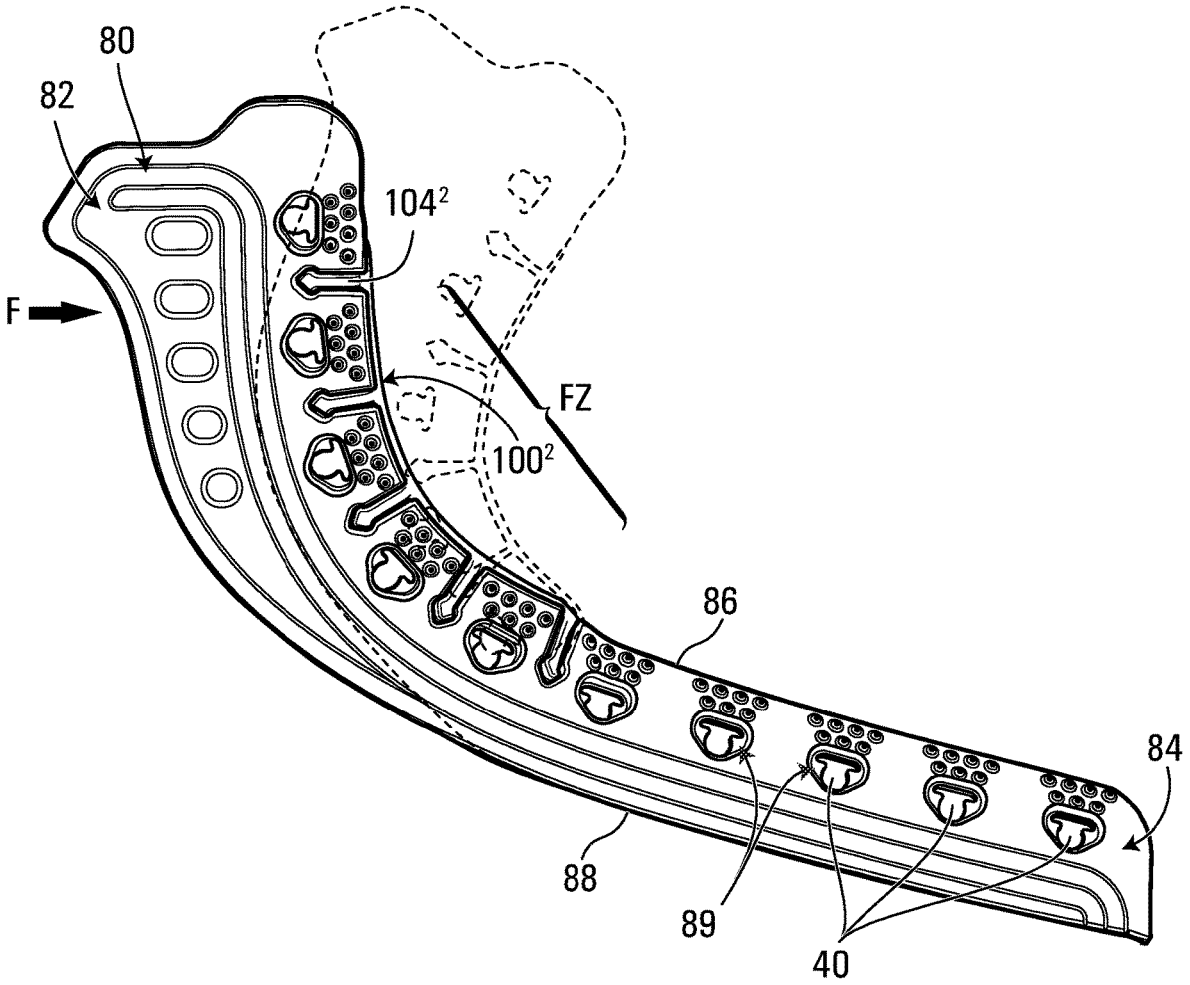

With reference to FIG. 9, a first embodiment of an insert 100 is shown. The insert 100 has a main body portion 102 from which a plurality of protrusions 104 extend. The main body portion 102 of the insert 100 may be at least partially received in the grooves 92 of the edge portions 91. Furthermore, each protrusion 104 is shaped to cooperate with a corresponding opening 90 of the lace member 80 (as shown in FIGS. 6, 11 and 12). In particular, each of the protrusions 104 may have a length $L_P$ (see FIG. 9) substantially equal to the length $L_O$ of the openings 90 (see FIG. 7). Moreover, each of the protrusions 104 has a shaft portion 104A, a distal portion 104B and ridges 104C located between the shaft portion 104A and the distal portion 104B. The shaft portion 104A, distal portion 104B and ridges 104C of a given protrusion 104 respectively fit in the corresponding opening 90 defined by opposed walls 90A, opposed distal inclined walls 90B and opposed rounded walls 90C.

Figure 10:
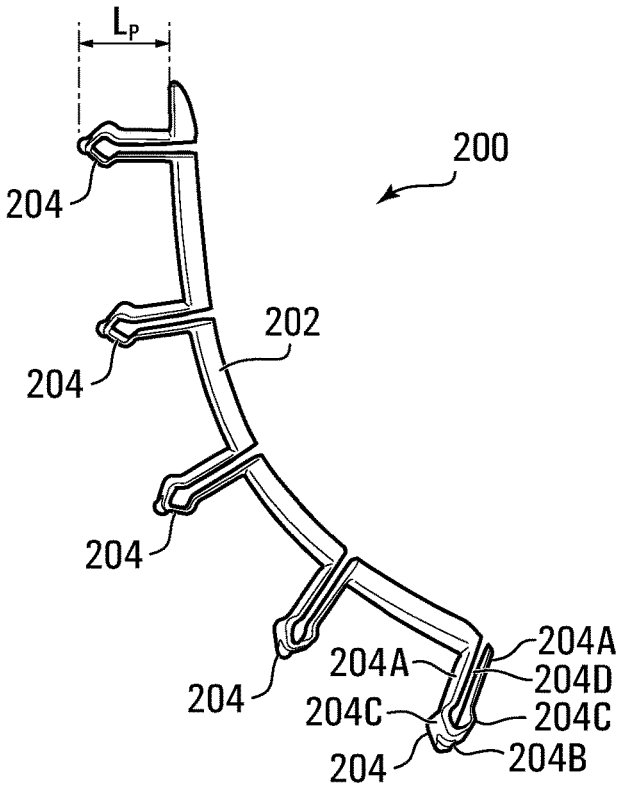

With reference to FIG. 10, a second embodiment of an insert 200 is shown wherein each of the protrusions 204 has a spacing (depicted as a slit 204D) extending from the main body portion 202 towards the distal portion 204B of the protrusion 204. The protrusion 204 has a shape that is substantially similar to the shape of the protrusion 104 but instead of being a full body as the protrusion 104, the protrusion 204 is defined by thin walls 204A defining the slit 204D and being joined together at the distal portion 204B. The protrusion 204 may also have ridges 204C between the walls 204A and distal portion 204B. The slit 204D may have a thickness of approximately 1 mm between the walls 204A and a maximum thickness of approximately 2 mm at the ridges 204C. Other slit dimensions can readily be envisioned by a person of skill in the art. Moreover, the slit 204D may be replaced by any other type of spacing, hole or indentation on the protrusion 204 or may be filled or occupied by a further insert that may be made from a material different from the one of the insert 200.

Furthermore, the protrusions of a given insert need not be substantially similar in shape. Rather, the protrusions of a same insert can vary in shape from one another to fit in corresponding openings on a lace member 80. In such an embodiment, the openings of a given lace member 80 will also differ in shape as mentioned previously. For example, the openings located along a middle region of the flexion zone FZ can be larger to accommodate protrusions of larger size. This may be desirable as the middle region of the flexion zone FZ is likely to exhibit the most flexion forces when the skate boot 10 is in use.

In other embodiments, the insert can include a single protrusion which would fit in a single corresponding opening on the lace member 80. In yet other embodiments, it is not necessary that the number of protrusions on the insert and the number of openings on the lace member 80 be equal. For example, a greater number of openings than protrusions can be provided, thereby permitting a skater to select which openings to fill with one or more protrusions.

It is also understood that the main body portion 102 may be omitted such that the insert or inserts are separate single inserts, each defining a protrusion for registering in a given opening of the lace member 80.

In addition to modifying the shape of the inserts 100, 200, different inserts 100, 200 can be made of different materials having different hardness values. For example, inserts 100, 200 can be molded from any type of rubber such as natural rubber, isoprene rubber, polychloroprene, styrene butadiene rubber, etc.

Depending on the material, the inserts 100, 200, and/or their protrusions 104, 204 if the inserts have a body portion, may have hardness values between 20 Shore A and 70 Shore D. For example, a very hard insert may have a hardness value between 60 and 70 Shore D, a hard insert may have a hardness value between 40 and 50 Shore D, a medium insert may have a hardness value between 20 and 30 Shore D, a soft insert may have a hardness value between 5 and 15 Shore D, and a very soft insert may have a hardness value between 15 and 25 Shore A. It is also understood that the insert may comprise a frame, skeleton or armature made of a relatively rigid material being covered or overmolded by a material having a hardness value lower from the one of the rigid material.

The inserts 100, 200 and/or the protrusions 104, 204 may be made of a material which is more flexible than the lace member 80 such that the protrusions 104, 204 can be compressed in the openings 90 when the lace member 80 experiences in-plane bending. Furthermore, in order to differentiate one insert from another, an insert with a particular characteristic can have a differentiating feature (such as a specific color). As such, if a skater were to lose (or damage) a preferred insert, the skater can easily identify and purchase a new replacement insert identical to the lost (or damaged) insert.

It can therefore be appreciated that a plurality of inserts 100, 200 can be produced with different specifications, thereby allowing a skater to at least partially define the amount of flexibility permitted in the flexion zone FZ of the lace member 80. The term "specification" may refer to any mechanical property or dimension of a given insert (such as hardness, density, shape, thickness, etc.).

Although the presence of the insert 100 in the lace member 80 may not substantially affect the level of out-of-plane bending, the insert 100 or insert 200 may affect the level of in-plane bending which occurs during flexion and extension of a skater's foot F. Nevertheless, if the skater determines that the natural resiliency of the lace member 80 without any inserts is adequate, the lace member can simply be used with the openings 90 free of any inserts.

The use of different inserts 100, 200 in combination with the lace member 80 will cause the lace member 80 to experience bending under different flexion modes. This will be described in further detail with reference to FIGS. 11 and 12 which illustrate a lace member 80 experiencing bending under a similar flexion force. The expression "flexion force" can be understood to represent any type of physical force or pressure capable of bending the lace member 80.

In FIG. 11, a first insert $\mathbf{100}^1$ is positioned in the openings 90 of the lace member 80 while in FIG. 12, a second insert $\mathbf{100}^2$ different from the first insert $\mathbf{100}^1$ is positioned in the openings 90 of the lace member 80.

In FIG. 11, the lace member 80 is shown in an initial (rest) position in solid lines and in a first (bent) position in dotted lines. Similarly, in FIG. 12, the lace member 80 is shown in the initial (rest) position in solid lines and in a second (bent) position in dotted lines.

Force vector F schematically depicts a force which would be exerted onto the lace member 80 in response to the flexion of a skater's foot. Force vector F is the same in both of FIGS. 11 and 12 and is applied at the same point on the lace member 80 in order to represent equivalent flexion forces in each of the cases shown. While force vector F is shown as being applied along a particular line of action, it is understood that, other forces can be applied to the lace member 80 along any line of action to cause the lace member 80 to experience bending.

With continued reference to FIGS. 11 and 12, it can be seen that, for a same flexion force (or pressure), the lace member 80 including the first insert $\mathbf{100}^1$ (FIG. 11) has a first flexion mode (as depicted by the first position of the lace member 80 shown in dotted lines), while the lace member 80 including the second insert $\mathbf{100}^2$ (FIG. 12) has a second flexion mode (as depicted by the second position of the lace member 80 shown in dotted lines), the second flexion mode being different from the first flexion mode because each of the inserts $\mathbf{100}^1$, $\mathbf{100}^2$ has different specifications.

Moreover, because of the different specifications of the inserts $\mathbf{100}^1$, $\mathbf{100}^2$, when the flexion force is no longer applied to the lace member 80, this lace member 80 may return to its initial position shown in solid lines according to different counter-forces.

In addition, it can be understood that the more the lace member 80 is bent, the more the top part of each protrusion of the insert is "pinched" (compressed). In this example, first insert $\mathbf{100}^1$ has a higher hardness than second insert $\mathbf{100}^2$. For instance, the first insert $\mathbf{100}^1$ may have a hardness value higher than 30 Shore A while the second insert $\mathbf{100}^2$ may have a hardness value lower than 30 Shore A, or the first insert $\mathbf{100}^1$ may have a hardness value higher than 40 Shore A while the second insert $\mathbf{100}^2$ may have a hardness value lower than 40 Shore A, or the first insert $\mathbf{100}^1$ may have a hardness value higher than 50 Shore A while the second insert $\mathbf{100}^2$ may have a hardness value lower than 50 Shore A, etc.

As such, the top part of each protrusion $\mathbf{104}^2$ is pinched more than the top part of each protrusion $\mathbf{104}^1$ for a same flexion force.

As such, the presence of a given insert in the openings 90 of the lace member 80 will modify the overall resiliency of the lace member 80 and define, at least in part, the flexion mode of the lace member 80 as it experiences flexion forces. In other words, for a given flexion force exerted on the lace member 80, the lace member 80 has a first flexion mode when a first insert is positioned in the openings 90 of the lace member 80, while the lace member 80 has a second flexion mode when a second insert is positioned in the openings 90 of the lace member 80, the first flexion mode being different from the second flexion mode.

It should be understood that the expression "flexion mode" should not be restricted to a particular position of the lace member 80. Rather, the expression "flexion mode" is meant to generally represent a range of positions achieved by a given lace member 80 as it reacts under an array of possible flexion forces.

Any feature of any embodiment discussed herein may be combined with any feature of any other embodiment discussed herein in some examples of implementation.

Various embodiments and examples have been presented for the purpose of describing, but not limiting, the invention. Various modifications and enhancements will become apparent to those of ordinary skill in the art and are within the scope of the invention, which is defined by the appended claims.

The invention claimed is:

1. A skate boot for receiving a foot of a user of a skate, the skate boot being configured to support the user's foot above a skating element of the skate, the skate boot comprising:

a shell comprising a lateral side portion configured to face a lateral side of the user's foot, a medial side portion configured to face a medial side of the user's foot, and an ankle portion configured to receive an ankle of the user; and a lacing member configured to lace the skate boot and comprising:

lacing apertures to receive a lace; and flexion openings disposed between adjacent ones of the lacing apertures and configured to facilitate flexing of the lacing member when the user's foot moves during skating, each flexion opening comprising an outer portion and an inner portion that is farther from a top edge of the lacing member and wider in a longitudinal direction of the lacing member than the outer portion of the flexion opening.

2. The skate boot of claim 1, wherein the flexion openings are elongated.

3. The skate boot of claim 2, wherein the flexion openings are longer than the lacing apertures.

4. The skate boot of claim 2, wherein the flexion openings are longer and narrower than the lacing apertures.

5. The skate boot of claim 2, wherein each of the flexion openings comprises walls opposite to one another and moveable relative to one another when the user's foot moves during skating.

6. The skate boot of claim 1, wherein the flexion openings extend from the top edge of the lacing member.

7. The skate boot of claim 1, wherein the flexion openings are free of any insert therein.

8. The skate boot of claim 1, wherein the lacing member comprises an insert disposed in at least one of the flexion openings.

9. The skate boot of claim 1, wherein the lacing member is mounted to the shell.

10. The skate boot of claim 9, wherein the lacing member is mounted to the shell by at least one of stitching, over molding, thermal bonding, high frequency welding, vibration welding, piping, a zipper, an adhesive, and staples.

11. The skate boot of claim 1, wherein the lacing member is injection molded.

12. The skate boot claim 1, wherein the lacing member is integrally formed with the shell.

13. The skate boot of claim 1, wherein the flexion openings include at least three flexion openings.

14. The skate boot of claim 1, wherein the flexion openings include at least four flexion openings.

15. The skate boot of claim 1, wherein: the lacing member is a lateral lacing member; and the skate boot comprises a medial lacing member configured to lace the skate boot and comprising:

lacing apertures to receive the lace; and flexion openings disposed between adjacent ones of the lacing apertures of the medial lacing member and configured to facilitate flexing of the medial lacing member when the user's foot moves during skating, each flexion opening of the medial lacing member comprising an outer portion and an inner portion that is farther from a top edge of the medial lacing member and wider in a longitudinal direction of the medial lacing member than the outer portion of the flexion opening of the medial lacing member.

16. A skate comprising the skate boot of claim 1 and a skating element below the skate boot.

17. A skate boot for receiving a foot of a user of a skate, the skate boot being configured to support the user's foot above a skating element of the skate, the skate boot comprising:

a shell comprising a lateral side portion configured to face a lateral side of the user's foot, a medial side portion configured to face a medial side of the user's foot, and an ankle portion configured to receive an ankle of the user; and a lacing member configured to lace the skate boot and comprising:

lacing apertures to receive a lace; and flexion openings disposed between adjacent ones of the lacing apertures, extending from a top edge of the lacing member, and free of any insert therein, each flexion opening comprising an outer portion and an inner portion that is farther from the top edge of the lacing member and wider in a longitudinal direction of the lacing member than the outer portion of the flexion opening.

18. A skate boot for receiving a foot of a user of a skate, the skate boot being configured to support the user's foot above a skating element of the skate, the skate boot comprising:

a shell comprising a lateral side portion configured to face a lateral side of the user's foot, a medial side portion configured to face a medial side of the user's foot, and an ankle portion configured to receive an ankle of the user; and a lacing member that is configured to lace the skate boot, is injection molded, and comprises:

lacing apertures to receive a lace; and flexion facilitators disposed between adjacent ones of the lacing apertures and configured to facilitate flexing of the lacing member when the user's foot moves during skating;

wherein: the flexion facilitators include flexion openings; and each flexion opening comprises an outer portion and an inner portion that is farther from the top edge of the lacing member and wider in a longitudinal direction of the lacing member than the outer portion of the flexion opening.

19. The skate boot of claim 18, wherein the flexion openings are elongated.

20. The skate boot of claim 18, wherein the flexion openings are free of any insert therein.

21. The skate boot of claim 18, wherein the lacing member comprises an insert disposed in at least one of the flexion openings.

22. The skate boot of claim 18, wherein the flexion facilitators comprise a flexible material that is more flexible than a main material of the lacing member.

23. The skate boot of claim 22, wherein the lacing member is mounted to the shell by at least one of stitching, over molding, thermal bonding, high frequency welding, vibration welding, piping, a zipper, an adhesive, and staples.

24. The skate boot of claim 18, wherein the flexion facilitators comprise flexion openings and an insert disposed in at least one of the flexion openings.

25. The skate boot of claim 18, wherein: the lacing member is a lateral lacing member; and the skate boot comprises a medial lacing member that is configured to lace the skate boot, is injection molded, and comprises:

lacing apertures to receive the lace; and flexion facilitators disposed between adjacent ones of the lacing apertures of the medial lacing member and configured to facilitate flexing of the medial lacing member when the user's foot moves during skating.

26. The skate boot of claim 18, wherein the flexion openings are longer than the lacing apertures.

27. The skate boot of claim 18, wherein the flexion openings are longer and narrower than the lacing apertures.

28. The skate boot of claim 18, wherein each of the flexion openings comprises walls opposite to one another and moveable relative to one another when the user's foot moves during skating.

29. The skate boot of claim 18, wherein the flexion openings extend from the top edge of the lacing member.

30. The skate boot of claim 18, wherein the lacing member is mounted to the shell.

31. The skate boot claim 18, wherein the lacing member is integrally formed with the shell.

32. The skate boot of claim 18, wherein the flexion openings include at least three flexion openings.

33. The skate boot of claim 18, wherein the flexion includes at least four flexion openings.

34. A skate comprising the skate boot of claim 18 and a skating element below the skate boot.

35. The skate of claim 34, wherein the skate is an ice skate and the skating element comprises a blade.

36. The skate of claim 16, wherein the skate is an ice skate and the skating element comprises a blade.

* * * * *